US009095897B2

(12) United States Patent
Sato et al.

(10) Patent No.: US 9,095,897 B2
(45) Date of Patent: Aug. 4, 2015

(54) CAST-STEEL POURING APPARATUS

(75) Inventors: Takahiro Sato, Aichi (JP); Shinichi Cyomatsuken, Aichi (JP); Zhong-zhi Zhang, Aichi (JP); Toru Hanai, Aichi (JP); Hideto Terada, Aichi (JP); Masayuki Kato, Aichi (JP); Hidemi Hattori, Kanagawa (JP)

(73) Assignees: AISIN TAKAOKA CO., LTD., Aichi (JP); SINTOKOGIO, LTD., Aichi (JP); FUJIWA DENKI CO., LTD., Aichi (JP)

( * ) Notice: Subject to any disclaimer, the term of this patent is extended or adjusted under 35 U.S.C. 154(b) by 72 days.

(21) Appl. No.: 13/985,696

(22) PCT Filed: Feb. 22, 2012

(86) PCT No.: PCT/JP2012/001174

§ 371 (c)(1),
(2), (4) Date: Aug. 15, 2013

(87) PCT Pub. No.: WO2012/132209

PCT Pub. Date: Oct. 4, 2012

(65) Prior Publication Data

US 2014/0015174 A1 Jan. 16, 2014

(30) Foreign Application Priority Data

Mar. 29, 2011 (JP) ..... 2011-072543

(51) Int. Cl.
*B22D 41/06* (2006.01)
*B22D 41/01* (2006.01)

(52) U.S. Cl.
CPC ..... *B22D 41/06* (2013.01); *B22D 41/01* (2013.01)

(58) Field of Classification Search
CPC ..... B22D 41/00; B22D 41/04; B22D 41/06; B22D 41/01
USPC ..... 266/236
See application file for complete search history.

(56) References Cited

U.S. PATENT DOCUMENTS 3,531,074 A * 9/1970 Dine Cletus R Van et al. ..... 248/141
3,751,854 A * 8/1973 Huwyler et al. ..... 49/260
2014/0015174 A1* 1/2014 Sato et al. ..... 266/160

FOREIGN PATENT DOCUMENTS

JP S58-087099 6/1983
JP H07-112270 5/1995

(Continued)

OTHER PUBLICATIONS

English Language Machine translation of JP 2012-11443, Jan. 2012.*

(Continued)

*Primary Examiner* — Scott Kastler
(74) *Attorney, Agent, or Firm* — IP & T Group LLP

(57) ABSTRACT

A cast-steel pouring apparatus including a furnace body having a furnace main body that includes a fire-retardant lining material demarcating a retainer chamber for retaining molten steel therein, and a steel-outing trough unit that protrudes from the furnace main-body toward an outside and with a trough length equal to ⅔ or less of an inside diameter of a top-face opening in the retainer chamber; a first pivot shaft having a first axial line oriented along a lateral direction such that the furnace body can pivot on the first pivot shaft in a longitudinal direction; a first pivot driving source for causing the furnace body to pivot about the first axial line of the first pivot shaft which serves as the pivotal center in the longitudinal direction, thereby causing the molten steel to discharge from the steel-outing trough unit of the furnace body, which has pivoted with respect to a sprue of casting mold.

8 Claims, 7 Drawing Sheets

(56) References Cited

FOREIGN PATENT DOCUMENTS

| | | |
|---|---|---|
| JP | H08-025024 | 1/1996 |
| JP | H09-168858 | 6/1997 |
| JP | 2010-519041 | 6/2010 |
| JP | 2012-011443 | 1/2012 |
| WO | WO 2008/099556 | 8/2008 |

OTHER PUBLICATIONS

Notification of Reasons for Refusal issued by the Japanese Patent Office on Nov. 19, 2013.

* cited by examiner

PRIOR ART

PRIOR ART

CAST-STEEL POURING APPARATUS

BACKGROUND

1. Field on the Invention

The present invention relates to a cast-steel pouring apparatus for casting molten steel of cast steel, whose solidification initiation temperature is higher than that of cast iron, into a casting mold.

2. Description of Related Art

It has been said that it is not necessarily easy to cast molten steel of cast steel whose carbon content is less than that of cast iron in order to manufacture cast-steel products in defect-free-product state as reducing defective fractions. This results from the fact that, unlike cast iron, since molten steel of cast steel whose carbon content is less has a high solidification initiation temperature, a casting temperature of molten steel is high, and so on. When such a circumstance is taken into consideration, it has been requested for molten steel of cast steel that the casting be completed within a shorter period of time as much as possible.

In related art, Japanese Unexamined Patent Publication (KOKAI) Gazette No. 8-25024 discloses a casting apparatus, although it is not one which is limited to cast steel. This casting apparatus comprises: a furnace body having a fire-retardant lining material that demarcates a retainer chamber for retaining molten steel of cast steel therein; a first pivot shaft orienting along a lateral direction; and a first pivot driving source for causing the furnace body to pivot along a longitudinal direction about the first pivot shaft that serves as the pivotal center. When the first pivot driving source is driven, the furnace body is caused to pivot about the first pivot shaft that serves as the pivotal center, and then the molten steel, which is retained in the retainer chamber, is caused to discharge from an opening of the furnace body toward a sprue of casting mold. The above reference discloses that since the drop position of molten metal, which is caused to discharge from the furnace body changes, it is made so as to move the casting mold in the front/rear and right/left directions, in order to cope with the changed positions.

SUMMARY

In the current related art, since the furnace body does not comprise any steel-outing trough unit for causing the molten metal to discharge, it is not easy to identify the drop position onto which the molten metal drops, and accordingly there are limitations to shortening the casting time.

The present invention is one which has been conceived in view of the aforementioned circumstances, and accordingly it provides a cast-steel pouring apparatus that can contribute to shortening a casting time for casting molten steel of cast steel into a sprue of casting mold.

One aspect of the present invention is a cast-steel pouring apparatus comprising: a furnace body, a first pivot shaft, and a first pivot driving source; the furnace body having a main-body that has a fire-retardant lining material demarcating a retainer chamber for retaining molten steel of cast steel therein, and a steel-outing trough unit that not only protrudes from said furnace-body main body toward the outside but also whose trough length is set up to ⅔ or less of an inside diameter of a top-face opening in said retainer chamber; the first pivot shaft having a first axial line that orients along a lateral direction in which said furnace body is caused to pivot along a longitudinal direction; the first pivot driving source for causing said furnace body to pivot about said first axial line of said first pivot shaft, which serves as the pivotal center, along the longitudinal direction, thereby causing the molten steel to discharge from said steel-outing trough unit of said furnace body, which has been caused to pivot, with respect to a sprue of casting mold; in a standby state where said furnace body is put in place so as to make the center line of said furnace body orient along the vertical direction; said first axial line of said first pivot shaft is positioned on a more diametrically inner side than is a first imaginary extension line of an outer-circumference wall face in said furnace-body main body, and is positioned on a more diametrically outer side than is a second imaginary extension line of an inner-circumference wall face in said fire-retardant lining material that said furnace-body main body has; and as said steel-outing trough unit protrudes from said furnace body upward or upward and outward obliquely, a steel-outing leading end of said steel-outing trough unit is positioned on a more diametrically inner side than is said first imaginary extension line of said outer-circumference wall face in said furnace-body main body, and is positioned on a more diametrically outer side than is said second imaginary extension line of said inner-circumference wall face in said fire-retardant lining material that said furnace-body main body has.

As for the first pivot driving source, motor devices, and fluidic-pressure cylinder devices can be exemplified.

In accordance with the present aspect, the first axial line of the first pivot shaft is positioned on a more diametrically inner side than is a first imaginary extension line of an outer-circumference wall face in the furnace-body main body, and is positioned on a more diametrically outer side than is a second imaginary extension line of an inner-circumference wall face in the fire-retardant lining material that the furnace-body main body has, in a standby state where the furnace body is put in place so as to make the center line of the furnace body orient along the vertical direction.

In addition, the steel-outing trough unit protrudes from the furnace body upward or upward and outward obliquely. In the aforementioned standby state, a steel-outing leading end of the steel-outing trough unit is positioned on a more diametrically inner side than is the first imaginary extension line of the outer-circumference wall face in the furnace-body main body, and is positioned on a more diametrically outer side than is the second imaginary extension line of the inner-circumference wall face in the fire-retardant lining material that the furnace-body main body has.

In accordance with the present aspect, the first pivot driving source is driven at the time of outing steel so that the furnace body is caused to pivot about the first axial line of the first pivot shaft, which serves as the pivotal center, in a steel-outing direction, thereby causing the molten steel in the retainer chamber to discharge from the steel-outing leading end of the steel-outing trough unit in the furnace body. The discharged molten steel is received by the sprue of casting mold (or molten-steel receiving unit). Upon thus outing steel, it is possible to shorten a distance between the steel-outing leading end of the steel-outing trough unit and the first axial line of the first pivot shaft, and accordingly it is possible to make a pivotal radius smaller for causing the steel-outing leading end of the steel-outing trough unit to pivot. Consequently, it is possible to efficiently cause the molten steel in the retainer chamber of the furnace body to discharge with respect to the sprue of casting mold as being aimed at within a short period of time. By means of this, it is possible to shorten a time for casting the molten steel of casting steel. Since it is possible to make the pivotal radius smaller for causing the steel-outing leading end of the steel-outing trough unit to pivot, it is also possible to reduce fluctuations in the pouring speed. Consequently, it is not needed to make a retaining temperature of the molten steel higher excessively, molten steel which is retained in the retainer chamber of the furnace body, and accordingly it is possible to set up the retaining temperature of the molten steel lower as much as possible, molten steel which is retained in the retainer chamber of the furnace body.

(2) In accordance with the cast-steel pouring apparatus according to a second aspect, the cast-steel pouring apparatus is characterized in that, in the aforementioned aspect, a second pivot shaft is disposed in the furnace-body main body, the second pivot shaft not only having a second axial line that orients in the lateral direction in which the furnace body is caused to pivot along the longitudinal direction, but also causing the furnace body to pivot toward a steel-outing direction without causing the molten steel in the retainer chamber to discharge in a pivotal previous period;

the furnace body is caused to pivot in the steel-outing direction about the second pivot shaft, which serves as the pivotal center, without subjecting the molten steel in the retainer chamber to steel outing from the steel-outing trough unit in the pivotal previous period; and the molten steel in the retainer chamber is caused to discharge from the steel-outing trough unit toward the sprue of the casting mold, as the first pivot driving source causes the furnace body to pivot about the first pivot shaft, which serves as the pivot center, in a pivotal later period.

In a pivotal previous period, the furnace body is caused to pivot about the second pivot shaft, which serves as the center, in the steel-outing direction. In this case, it is also allowable to employ a second pivot driving source, such as motor devices; alternatively, it is even permissible to cause the furnace body to pivot in the steel-outing direction as the furnace body is sling held by a crane, and the like. However, the molten steel in the retainer chamber is not caused to discharge at all, in the pivotal previous period. In a pivotal later period, the molten steel in the retainer chamber is caused to discharge toward the sprue of casting mold in order to carry out casting, as the first pivot driving source causes the furnace body to pivot about the first pivot shaft that serves as the pivotal center.

(3) In accordance with the cast-steel pouring apparatus according to a third aspect, the cast-steel pouring apparatus is characterized in that, in the aforementioned aspect, a second pivot driving source is further disposed therein, the second pivot driving source for causing the furnace body to pivot about the second axial line of the second pivot shaft, which serves as the pivotal center, in the steel-outing direction in the pivotal previous period. When the second pivot driving source is driven in the pivotal previous period where the furnace body is caused to pivot, it is possible to cause the furnace body to pivot about the second pivot shaft, which serves as the pivotal center, in the steel-outing direction. As for the second pivot driving source, motor devices, and fluidic-pressure cylinder devices can be exemplified.

(4) In accordance with the cast-steel pouring apparatus according to a fourth aspect, the cast-steel pouring apparatus is characterized in that, in the aforementioned aspect, the cast-steel pouring apparatus further comprises:

a fixation unit;

an outer frame being supported onto the fixation unit pivotably about the second pivot shaft, which serves as the pivotal center, in the steel-outing direction; and an inner frame retaining the furnace body therein, the inner frame being supported onto the outer frame pivotably about the first pivot shaft, which serves as the pivotal center, in the steel-outing direction.

In the pivotal previous period, the outer frame pivots about the second pivot shaft, which serves as the pivotal center, in the steel-outing direction. Next, in the pivotal later period, along with the furnace body, the inner frame pivots about the first pivot shaft, which serves as the pivotal center, in the steel-outing direction. In this way, the molten steel, which is retained in the retainer chamber of the furnace body, is poured into the sprue of casting mold.

As described above, in accordance with an aspect of the present invention, the first pivot driving source is driven to cause the furnace body to pivot about the first axial line of the first pivot shaft, which serves as the pivotal center, in the steel-outing direction at the time of steel outing, thereby causing the molten steel in the retainer chamber to discharge from the steel-outing leading end of the steel-outing trough unit in the furnace body. The molten steel, which has been discharged, is received by the sprue of casting mold. Upon thus outing steel, it is possible to shorten a distance between the steel-outing leading end of the steel-outing trough unit and the first axial line of the first pivot shaft, and accordingly it is possible to make a pivotal radius smaller for causing the steel-outing leading end of the steel-outing trough unit to pivot.

Since it is possible to thus make the pivotal radius for the steel-outing leading end of the steel-outing trough unit smaller, it is possible to reduce fluctuations as well in the pouring angle for causing molten steel to pour with respect to casting mold; and accordingly it is possible to efficiently cause molten steel to discharge with respect to the casting mold's sprue as aimed at within a short period of time, upon casting the molten steel in a singularity of casting mold. Moreover, even when casting molten steel into a plurality of casting molds, it is possible to efficiently cause the molten steel to discharge with respect to the respective casting molds' sprue as aimed at within a short period of time. By means of these, upon casting molten steel with respect to a casting mold, and furthermore upon casing molten steel into a plurality of casting molds, it is possible to set up a molten-steel retaining temperature lower, at which molten steel is retained in the retainer chamber of the furnace body, as much as possible, because it is possible to shorten a casting time for casting molten steel into casting mold. It is eventually possible to set up a melting temperature lower as much as possible upon causing molten steel to melt by melting furnace, and accordingly it is possible to contribute to reductions in costs required for melting steel. In addition, it is possible to contribute to causing fluctuations to reduce in the molten-steel casting speed, because it is possible to intend shortening also in the steel-outing trough unit's trough length.

As aforementioned, since it is possible to make a casting temperature of molten steel lower as much as possible upon casting molten metal of cast steel in accordance with the present invention, it is possible to keep down reactions between materials for casting mold, such as casting sands, and molten steel. Accordingly, it is possible to suppress the seizure phenomenon where casting sands have seized onto cast steel's casting surfaces, and consequently it is possible to contribute to improvements in casting surfaces on the resulting cast steel. In addition, it is possible to reduce shrinkage defects in the resultant cast steel, because it is possible to make a casting temperature of molten steel lower as much as possible.

DETAILED DESCRIPTION

Figure 1:
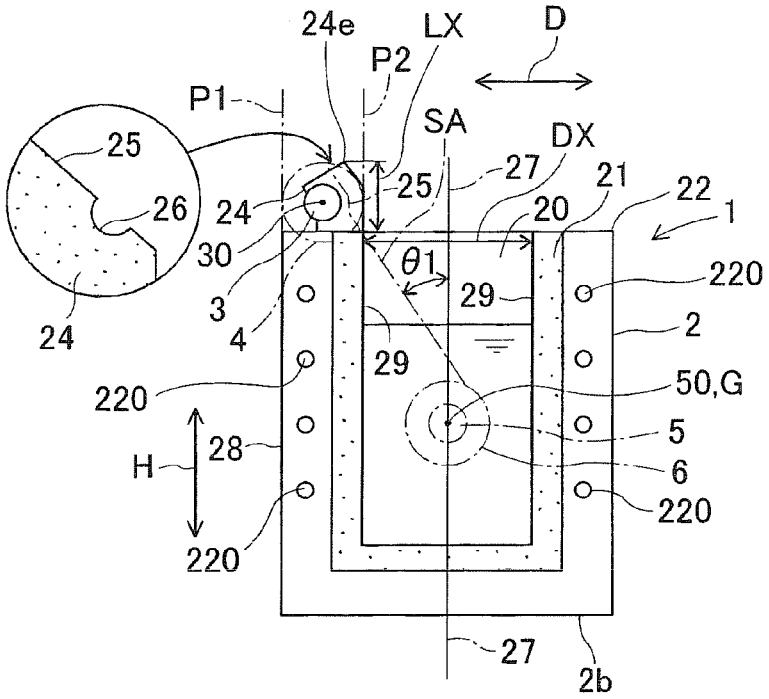
FIG. 1 concerns Embodiment Mode No. 1, and is a conceptual diagram for schematically illustrating a furnace body that is present at a standby position.

The following reference numerals apply to the figures, 1 specifies the cast-steel pouring apparatus; 2 specifies the furnace body; 20 specifies the retainer chamber; 21 specifies the fire-retardant lining material; 22 specifies the furnace-body main body; 24 specifies the steel-outing trough unit; 24*e* specifies the steel-outing leading end; 27 specifies the center line of the furnace body; 28 specifies the outer-circumference wall face; 29 specifies the inner-circumference wall face; "P2" specifies the second imaginary extension line; 3 specifies the first pivot shaft; 30 specifies the first axial line; 4 specifies the first pivot driving source; 5 specifies the second pivot shaft; 50 specifies the second axial line; 6 specifies the second pivot driving source; 100 specifies the casting mold; and 101 specifies the sprue.

In a standby state where a furnace body is put in place so as to make the center line of the furnace body orient along the vertical direction, a first axial line of a first pivot shaft is positioned on a more diametrically inner side than is a first imaginary extension line of an outer-circumference wall face in a furnace-body main body, and is positioned on a more diametrically outer side than is a second imaginary extension line of an inner-circumference wall face in a fire-retardant lining material that the furnace-body main body has. In addition, a steel-outing leading end of a steel-outing trough unit is positioned on a more diametrically inner side than is the first imaginary axial line of the outer-circumference wall face in the furnace-body main body, and is positioned on a more diametrically outer side than is the second imaginary extension line of the inner-circumference wall face in the fire-retardant lining material that the furnace-body main body has. The furnace body can comprise an induction heating coil, too, or cannot comprise it, either. As for a first pivot driving source and a second pivot driving source, they can also be motor devices, or can even be fluidic-pressure cylinder devices as far as they are able to cause the furnace body to pivot.

Figure 2:
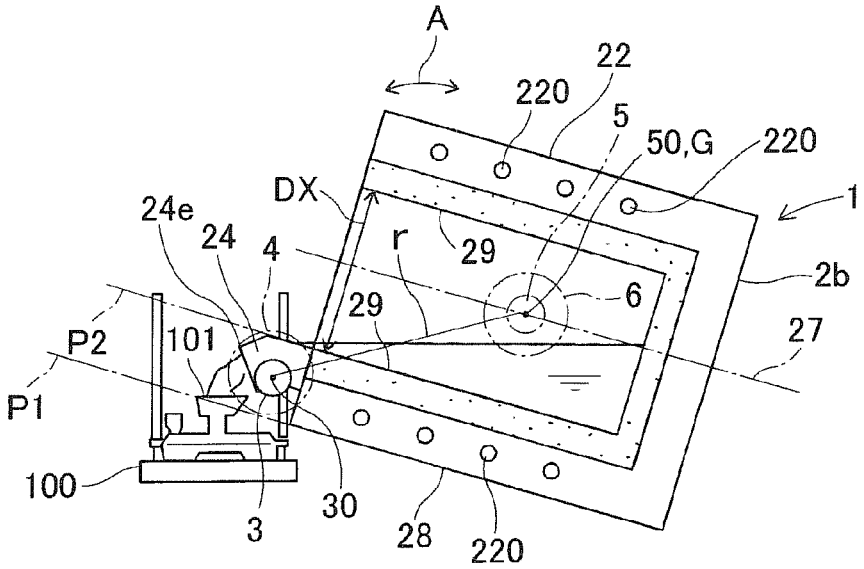
FIG. 2 concerns Embodiment Mode No. 1, and is a diagram for schematically illustrating a state where pouring is done from the furnace body, which is present at the standby position, to a sprue of casting mold.

FIG. 1 and FIG. 2 illustrate concepts of Embodiment Mode No. 1 that concerns claims 1 and 2 according to the present invention. A cast-steel pouring apparatus 1 comprises a furnace body 2 being capable of functioning as a melting furnace that forms molten steel, a first pivot shaft 3, a first pivot driving source 4, a second pivot shaft 5, and a second pivot driving source 6. The furnace body 2 has a furnace-body main body 22 having a fire-retardant lining material 21 that demarcates a top-face-opened retainer chamber 20 for retaining molten steel of cast steel therein, and a steel-outing trough unit 24 protruding from the top end of the furnace-body main body 22 outward toward the upside obliquely. FIG. 1 illustrates a cross-sectional diagram that is taken along the center line 27 of the furnace body 2 and along the vertical direction. As illustrated in FIG. 1, a shortest distance "LX" from the top end of the furnace-body main body 22 to a steel-outing leading end 24*e* of the steel-outing trough unit 24 is set up to ⅔ or less of an inside diameter "DX" of the top-face opening in the retainer chamber 20, or ½ or less thereof, or ⅓ or less thereof. Therefore, a trough length of the steel-outing trough unit 24 is shortened, so that it is set up to ⅔ or less of the inside diameter "DX" of the top-face opening in the retainer chamber 20, or ½ or less thereof, or ⅓ or less thereof.

The fire-retardant lining material 21 and furnace-body main body 22 take on a bottomed cylindrical configuration, respectively. The furnace-body main body 22 has an induction heating coil 220 that is wound around the center line 27. The steel-outing trough unit 24 comprises a steel-outing passage 25 for causing molten steel to discharge, and a concave-shaped portion 26 (see FIG. 1) that is disposed in a bottom wall face of the steel-outing passage 25 so as to be deeper than is the bottom wall face of the steel-outing passage 25. Since some molten steel in the steel-outing passage 25 is reserved in the concave-shaped portion 26 of the steel-outing trough unit 24 when completing pouring the molten metal and then causing the molten metal to drain by causing the furnace body 2 to pivot in an opposite direction to a steel-outing direction (i.e., in one of the arrowheaded directions "A"), the molten-metal draining property is good.

As illustrated in FIG. 1, the first pivot shaft 3 has a first axial line 30 that orients along the lateral direction (i.e., along the horizontal direction) in order to cause the furnace body 2 to pivot in the steel-outing direction (i.e., in one of the arrowheaded directions "A") along the longitudinal direction. At a standby position of the furnace body 2 shown in FIG. 1, the first pivot shaft 3 is disposed on the upper side of the furnace body 2, is disposed so as to be positioned above the height-wise position of the center of gravity "G" in the furnace body 2, and is disposed adjacent to the steel-outing trough unit 24 in the height-wise direction (i.e., in the arrowheaded directions "H"). The first pivot driving source 4 causes the furnace body 2 to pivot in the steel-outing direction (i.e., in one of the arrowheaded directions "A") about the first axial line 30 of the first pivot shaft 3, which serves as the pivotal center, along the vertical direction, thereby causing some molten steel to discharge from the steel-outing trough unit 24 of the furnace body 2, which has been caused to pivot, with respect to a sprue 101 of casting mold 100. The first pivot driving source 4 is formed by a motor device. As for the casting mold 100, green-sand molds, shell-molding molds, and the like, can be exemplified.

FIG. 1 illustrates a state where the furnace body 2 is put on standby so as to make the center line 27 of the furnace body 2 orient along the vertical direction. In this standby state, the steel-outing trough unit 24 protrudes from the top of the furnace body 2 upward and outward obliquely. Therefore, the extension line "SA" of the bottom face in the steel-outing passage 25 of the steel-outing trough unit 24 inclines by an angle "θ1" with respect to the center line 27 of the furnace body 2.

As illustrated in FIG. 1, the first axial line 30 of the first pivot shaft 3 is positioned on a more diametrically inner side than is a first imaginary extension line "P1" of an outer-circumference wall face 28 in the furnace-body main body 22, and is positioned on a more diametrically outer side than is a second imaginary extension line "P2" of an inner-circumference wall face 29 in the fire-retardant material 21 of the furnace-body main body 22, in the diametric direction (i.e., in the arrowheaded directions "D") of the retainer chamber 20, in accordance with the state where the furnace body 2 is put in place so that it is put on standby so as to make the center line 27 of the furnace body 2 orient along the vertical direction.

As illustrated in FIG. 1, the steel-outing leading end 24*e* of the steel-outing trough unit 24 is positioned on a more diametrically inner side than is the first imaginary extension line "P1" of the outer-circumference wall face 28 in the furnace-body main body 22, and is positioned on a more diametrically outer side than is the second imaginary extension line "P2" of the inner-circumference wall face 29 in the fire-retardant material 21 of the furnace-body main body 22, in the diametric direction (i.e., in the arrowheaded directions "D"), in the standby state where the furnace body 2 is put in place so as to make the center line 27 of the furnace body 2 orient along the vertical direction. Thus, the trough length of the steel-outing trough unit 24 is set up to be smaller, and accordingly is set up to be smaller than is the inside diameter "DX" of the top-face opening in the retainer chamber 20.

The second pivot shaft 5 has a second axial line 50 that orients along the lateral direction (i.e., along the horizontal direction) in order to cause the furnace body 2 to pivot along the longitudinal direction. The second pivot shaft 5 is disposed in the furnace-body main body 22 in order that the furnace body 22 is caused to pivot toward the steel-outing direction (i.e., in one of the arrowheaded directions "A") without causing molten steel to discharge in a pivotal previous period. The second pivot driving source 6 causes the furnace body 2 to pivot about the second axial line 50 of the second pivot shaft 5, which serves as the pivotal center, in the steel-outing direction (i.e., in one of the arrowheaded directions "A"). The second pivot driving source 6 can be formed by a motor device, or a motor device with deceleration mechanism.

The furnace body 2, in which high-temperature molten steel of cast steel is retained in the retainer chamber 20, is on standby (see FIG. 1). The molten steel forms cast-steel products, such as heat-resistance cast steels and stainless cast steels. Under the circumstance, the second pivot driving source 6 is driven at the time of casting in a state where high-temperature molten steel of cast steel is retained in the retainer chamber 20 of the furnace body 2 (see FIG. 1), and is driven at the pivotal previous period in another state where driving the first pivot driving source 4 is stopped. Then, the furnace body 2 pivots about the second axial line 50 of the second pivot shaft 5, which serves as the pivotal center, toward the steel-outing direction (i.e., in one of the arrowheaded directions "A") along the longitudinal direction. In this case, not only the bottom 2*b* of the furnace body 2 is pushed up, but also the steel-outing trough unit 24 descends, about the second axial line 50 of the second pivot shaft 5 that serves as the pivotal center. When the furnace body 2 is caused to pivot to a targeted pivotal position, rotationally driving the second pivot driving source 6 is stopped, and thereby the pivotal previous period is terminated.

Next, shifting to a pivotal later period is undergone. That is, in the pivotal later period, the first pivot driving source 4 is driven rotationally, and accordingly the furnace body 2 pivots furthermore about the first axial line 30 of the first pivot shaft 3, which serves as the pivotal center, in the steel-outing direction (i.e., in one of the arrowheaded directions "A") along the longitudinal direction, in a state where rotationally driving the second pivot driving source 6 is stopped. By means of this, the center line 27 of the furnace body 2 inclines furthermore, and thereby not only the bottom 2*b* of the furnace body 2 is pushed up furthermore but also the steel-outing leading end 24*e* of the steel-outing trough unit 24 descends furthermore, as shown in FIG. 2.

Thus, in accordance with the present embodiment mode, the second pivot driving source 6 is driven to cause the furnace body 2 to pivot about the second axial line 50 of the second pivot shaft 5, which serves as the pivotal center, in the steel-outing direction (i.e., in one of the arrowheaded directions "A"), while stopping driving the first pivot driving source 4, at the time of steel outing in the pivotal previous period. When the furnace body 2 reaches the terminal position in the pivotal previous period, driving the second pivot driving source 6 is caused to stop. Thereafter, shifting to the pivotal later period is undergone, and then the first pivot driving source 4 is driven to cause the furnace body 2 to pivot furthermore about the first axial line 30 of the first pivot shaft 3, which serves as the pivotal center, in the steel-outing direction (i.e., in one of the arrowheaded directions "A"), in a state where driving the second pivot driving source 6 is caused to stop. By means of this, molten steel, which is retained in the retainer chamber 20 of the furnace body 2, is caused to discharge from the leading end of the steel-outing trough unit 24 in the furnace body 2. The discharged molten steel is received by the sprue 101 of the casting mold 100.

In accordance with the present embodiment mode like this, it is possible to make a pivotal radius smaller within which the steel-outing leading end 24*e* of the steel-outing trough unit 24 pivots, upon causing molten steel, which is retained in the retainer chamber 20 of the furnace body 2, to undergo steel outing in the pivotal later period. Hence, it is possible to reduce fluctuations as well in the pouring angle for causing molten steel to discharge with respect to casting mold, and accordingly molten-steel leakages at the sprue 101 of the casting mold 100 can be kept down at the time of casting the molten steel, which has undergone steel outing, into the sprue 101 of the casting mold 100.

Consequently, in accordance with the present embodiment mode, it is possible to efficiently cause molten steel, which is discharged from the steel-outing leading end 24*e* of the steel-outing trough unit 24, to discharge as aimed at with respect to the targeted position, namely, with respect to the sprue 101 of the casting molding 100, within a short period of time, while keeping down fluctuations in the pouring speed. By means of this, it is possible to shorten a casting time for casting the molten steel into the sprue 101 of the casting mold 100. Consequently, since it is possible to make a temperature of the molten steel, which is retained in the retainer chamber 20 of the furnace body 2, lower as much as possible, and eventually since it is possible to make a melting temperature of the molten steel lower, it is possible to reduce costs required for melting steel. Note that the casting mold 100 having the sprue 101 is disposed next to the furnace body 2 (see FIG. 2).

As described above, in accordance with the present embodiment mode, the first pivot driving source 4 is driven to cause the furnace body 2 to pivot about the first axial line 30 of the first swing shaft 30, which serves as the pivotal center, in the steel-outing direction (i.e., in one of the arrowheaded directions "A") at the time of steel outing in the pivotal later period, thereby causing molten steel, which is retained in the retainer chamber 20 of the furnace body 2, to discharge from the steel-outing leading end 24*e* of the steel-outing trough unit 24 in the furnace body 2 in one of the arrowheaded directions "A1" (i.e., in the discharging direction). The molten steel, which has been discharged from the steel-outing leading end 24*e* of the steel-outing trough unit 24, is received by a targeted position thereof, namely, by the sprue 101 of the casting mold 100. Upon thus subjecting the molten steel, which is in the retainer chamber 20 of the furnace body 2, to steel outing into the sprue 101 of the casting mold 100, it is possible to make a pivotal radius smaller within which the steel-outing leading end 24*e* of the steel-outing trough unit 24 pivots, because the furnace body 2 is caused to pivot, not about the second axial line 50 of the second pivot shaft 5, but about the first axial line 30, which serves as the pivotal center in the first pivot shaft 3 that is set up at a closer position to the steel-outing trough unit 24 than is the second pivot shaft 5, in the steel-outing direction (i.e., in one of the arrowheaded directions "A"). Since it is possible to thus make the pivotal radius of the steel-outing leading end 24*e* in the steel-outing trough unit 24 smaller, it is possible to cause molten steel to efficiently discharge as aimed at with respect to the sprue 101 of the casting mold 100 within a short period of time, and accordingly it is possible to reduce fluctuations as well in the molten-steel pouring speed, upon casting the molten steel into the sprue 101 of the casting mold 100. Consequently, even when casting molten steel into a plurality of the casting molds 100, it is possible to cause the molten steel to efficiently discharge as aimed at with respect to the sprue 101 of the respective casting molds 100 within a short period of time. By means of this, it is possible to set up a retaining temperature of the molten steel, which is retained in the retainer chamber 20 of the furnace body 2, lower as much as possible, because it is possible to shorten a casting time for casting the molten steel into the sprue 101 of the casting mold 100, upon casting the molten steel into a singularity of the casting mold 100, and moreover upon casting the molten steel into a plurality of the casting molds 100. Eventually, an advantage of enabling costs required for melting steel to reduce is obtainable, because it is possible to make a melting temperature of the molten steel lower as much as possible.

In accordance with the present embodiment mode being aforementioned, it is possible to keep down reactions between materials for the casting mold 100, such as casting sands, and molten steel within the casting mold 100, because it is possible to make a casting temperature of the molten steel lower as much as possible, upon casting the molten steel. Accordingly, it is possible to suppress the seizure phenomenon where casting sands have seized onto the resulting cast steel. In addition, it is possible to reduce shrinkage defects in the resultant cast steel, because it is possible to make a casting temperature of the molten steel lower as much as possible.

Moreover, since it is possible to shorten a trough length of the steel-outing trough unit 24, too, as described above, it is possible to contribute to causing fluctuations to reduce in the pouring speed, in accordance with the present embodiment mode. In addition, in accordance with the present embodiment mode, the second pivot shaft 5, which orients along the lateral direction (i.e., along the horizontal direction) in which the furnace body 2 is caused to pivot along the longitudinal direction, is disposed in the furnace-body main body 22. Not only the second pivot shaft 5 has the second axial line 50, but also it causes the furnace body 2 to pivot toward the steel-outing direction (i.e., in one of the arrowheaded directions "A") without causing any molten steel in the retainer chamber 20 to discharge in the pivotal previous period. And, when shifting to the pivotal later period is undergone, the first pivot driving source 4 can cause the molten steel in the retainer chamber 20 to discharge toward the sprue 101 of the casting mold 100, as causing the furnace body 2 to pivot about the first axial line 30 of the first pivot shaft 3, which serves as the pivotal center, in the pivotal later period. In other words, in the pivotal previous period, the second pivot driving source 6 is driven to cause the furnace body 2 to pivot, not about the first axial line 30 of the first pivot shaft 3, but about the second axial line 50 of the second pivot shaft 5 (that is closer to the center of gravity "G" in the furnace body 2 than is the first axial line 30 of the first pivot shaft 3), second axial line 50 which serves as the center, in the steel-outing direction (i.e., in one of the arrowheaded directions "A"). In the pivotal previous period like this, the molten steel inside the retainer chamber 20 in the furnace body 2 is not caused to discharge toward the sprue 101 of the casting mold 100. And, when shifting to the later pivotal period is undergone, the first pivot driving source 4 causes the molten steel in the retainer chamber 20 to discharge toward the sprue 101 of the casting mold 100 in order to carry out casting, as causing the furnace body 2 to pivot about the first axial line 30 of the first pivot shaft 3, which serves as the pivotal center, in the steel-outing direction (i.e., in one of the arrowheaded directions "A").

It is also possible to think of causing steel outing supposedly by means of causing the furnace body 2 to pivot about the first axial line 30 of the first pivot shaft 3, which serves as the pivotal center, by the first pivot driving source 4 from the standby position of the furnace body 2 to the steel-outing position of the furnace body 2, namely, from a starting timing in the pivotal previous period to a terminal timing in the pivotal later period. In this case, however, since a distance "r" (see FIG. 2) increases between the first axial line 30 of the first pivot shaft 3 and up to the mass center of the furnace body 2 while causing the furnace body 2 to pivot from the standby position (i.e., the starting timing in the pivotal previous period) to the steel-outing position (i.e., the pivotal later period), a moment becomes greater for causing the furnace body 2 to pivot about the first axial line 30 of the first pivot shaft 3 that serves as the pivotal center, so that there might be fears of making weight loads greater that are applied to the first pivot driving source 4 and first pivot shaft 3 and beside making a time longer during which the weight load is loaded to the first pivot shaft 3. Thus, it is disadvantageous for making a life of the first pivot shaft 3 longer.

In view of this, in accordance with the present embodiment mode, the second axial line 50 of the second pivot shaft 5 exists at a position that is closer with respect to the mass center of the furnace body 2, which retains molten steel therein, than does the first pivot shaft 3, as shown in FIG. 1. And, as described above, the second pivot driving source 6 is first of all driven to cause the furnace body 2 to pivot about the second axial line 50 of the second pivot driving shaft 5, which serves as the pivotal center, in the steel-outing direction (i.e., in one of the arrowheaded directions "A") in the pivotal previous period. Thereafter, shifting to the pivotal later period is undergone, and then the first pivot driving source 4 is driven to cause the furnace body 2 to pivot furthermore about the first axial line 30 of the first pivot driving shaft 3, which serves as the pivotal center, toward the steel-outing direction (i.e., in one of the arrowheaded directions "A"). By means of this, it is possible to suppress the increment of moment, which is required for pivoting, as much as possible in the pivotal previous period, so that it is possible to keep down the weight loads, which apply to the first pivot driving source 4 and first pivot shaft 3, as much as possible. Thus, it is possible to contribute to making a life of the first pivot shaft 3 longer.

Figure 12:
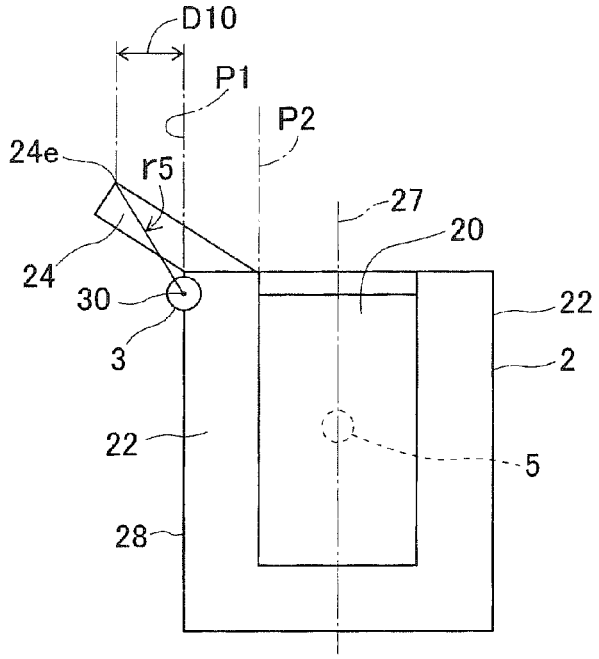
FIG. 12 concerns a comparative mode, and is a conceptual diagram for schematically illustrating a furnace body that is present at a standby position.
Figure 13:
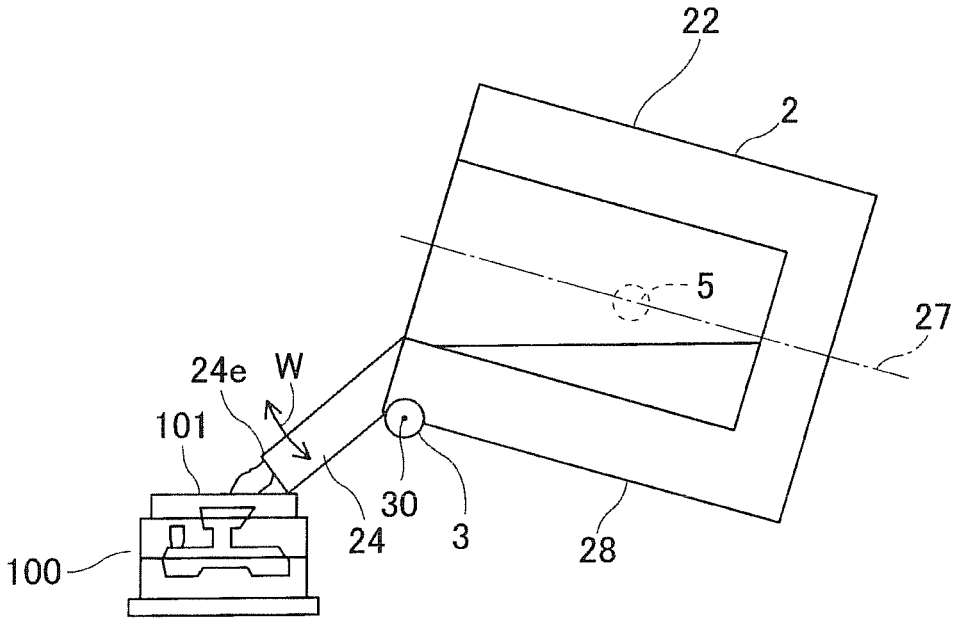
FIG. 13 concerns the comparative mode, and is a diagram for schematically illustrating a state where pouring is done from the furnace body, which is present at a casting position, to a sprue of casting mold.

FIG. 12 and FIG. 13 illustrate a cast-steel casting apparatus that concerns a comparative mode. This apparatus is equipped with: a furnace body 2 having a furnace-body main body 22, which has a retainer chamber 20 for retaining molten steel of cast steel therein, and a steel-outing trough unit 24 protruding from the furnace-body main body 22 toward the upside outwardly; a first pivot shaft 3 orienting along a lateral direction in which the furnace body 2 is caused to pivot along a longitudinal direction; a first pivot driving source (not shown) for causing the furnace body 2 to pivot about the first pivot shaft 3, which serves as a pivotal center, along the longitudinal direction, thereby causing the molten steel to discharge from the steel-outing trough unit 24 of the furnace body 2, which has been caused to pivot, with respect to a sprue 101 of casting mold 100; a second pivot shaft 5 orienting along the lateral direction in which the furnace body 2 is caused to pivot along the longitudinal direction; and a second pivot driving source (not shown) for causing the furnace body 2 to pivot about the second pivot shaft 5, which serves as another pivotal center, along the longitudinal direction, thereby causing the molten steel to discharge from the steel-outing trough unit 24 of the furnace body 2, which has been caused to pivot, with respect to the sprue 101 of the casting mold 100. In accordance with this one, the steel-outing trough unit 4 is disposed to extend on the upper side obliquely in a standby state (see FIG. 12) where the furnace body 2 is put in place so that the center line 27 of the furnace body 2 orients along the vertical direction.

In the standby state shown in FIG. 12, although the first axial line 30 of the first pivot shaft 3 is positioned adjacent to an outer-circumference wall face 28 of the furnace-body main body 22, a steel-outing leading end 24*e* of the steel-outing trough unit 24 is positioned on an outer side by a dimension "D10" in the horizontal direction than is a first imaginary extension line "P1" of the outer-circumference wall face 28 in the furnace-body main body 22. Consequently, in the comparative mode, a length of the steel-outing trough unit 24 is longer. Specifically, a distance "r5" (see FIG. 12) between the steel-outing leading end 24*e* of the steel-outing trough unit 24 and the first axial line 30 of the first pivot shaft 3 is greater. Consequently, at the time of casting during which molten steel in a retainer chamber 20 is poured into the sprue 101 of the casting mold 100, the position of the steel-outing leading end 24*e* of the steel-outing trough unit 24 shakes in the pivotal directions (i.e., in the arrowheaded directions "W" shown in FIG. 13), so that it takes some time in order for aiming with respect to the sprue 101 of the casting mold 100. Consequently, in accordance with the comparative mode, there is such a drawback that it takes a longer time for pouring the molten steel into the sprue 101 of the casting mold 100. In addition, fluctuations in the pouring angle for pouring molten steel into casting mold also augment, so that fluctuations in the pouring speed augment as well.

Consequently, there is such a drawback that a retaining temperature of molten steel, which is retained inside the retainer chamber 20 in the furnace body 2, and eventually a temperature for melting the molten steel should be made higher excessively, so that melting costs required for making molten steel augment. Moreover, since a pouring temperature of the molten steel becomes higher, sands constituting the casting mold 100, and the molten steel react with each other, so that there is a fear of degrading casting surfaces of cast-steel products in which the molten steel has solidified. In addition, it becomes necessary to pour the molten steel from a higher position, so that it is likely that the pouring speed becomes faster excessively at the time of casting, and so that it is likely to make a factor of molten-steel leakages in the casting mold 100.

FIG. 3 through FIG. 7 illustrate concepts of Embodiment Mode No. 2 schematically. Since the present embodiment mode comprises the same constructions, as well as the same operations and advantageous effects, as those of Embodiment Mode No. 1 fundamentally, it is possible to use FIG. 1 and FIG. 2 compliantly. The first axial line 30 of the first pivot shaft 3 is positioned on a more diametrically inner side than is the first imaginary extension line "P1" of the outer-circumference wall face 28 in the furnace-body main body 22 in the diametric direction of the furnace-body main body 22, and is positioned on a more diametrically outer side than is the second imaginary extension line "P2" of the inner-circumference wall face 29 of the fire-retardant lining material 21 in the furnace-body main body 22. The first pivot shaft 3 has the first axial line 30 that orients in the lateral direction (i.e., in the horizontal direction) in order to cause the furnace body 2 to pivot in the steel-outing direction (i.e., in one of the arrowheaded directions "A") along the longitudinal direction. The second pivot shaft 5 has the second axial line 50 that orients in the lateral direction (i.e., in the horizontal direction) in order to cause the furnace body 2 to pivot in the steel-outing direction (i.e., in one of the arrowheaded directions "A") along the longitudinal direction. As illustrated in FIG. 1 and FIG. 2 that are used compliantly, as the steel-outing trough unit 24 protrudes from the furnace body 2 to the upside and outside obliquely, the steel-outing leading end 24*e* of the steel-outing trough unit 24 is positioned on a diametrically inner side than is the first imaginary extension line "P1" of the outer-circumference wall face 28 in the furnace-body main body 22, and is positioned on a diametrically outer side than is the second imaginary extension line "P2" of the inner-circumference wall face 29 of the fire-retardant lining material 21 in the furnace-body main body 22.

Figure 3:
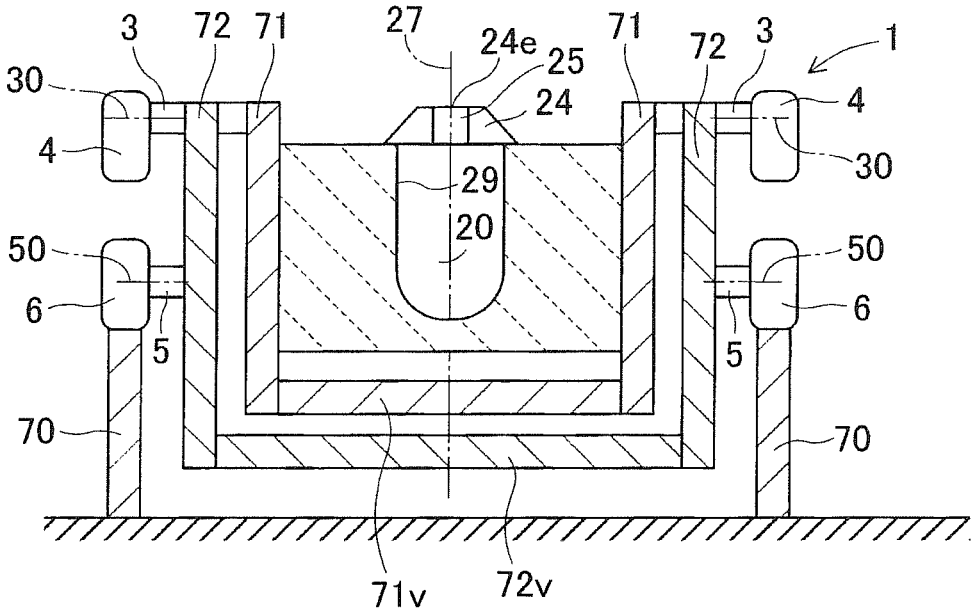
FIG. 3 concerns Embodiment Mode No. 2, and is a conceptual diagram for schematically illustrating a furnace body, which is present at a standby position, from a different direction.
Figure 6:
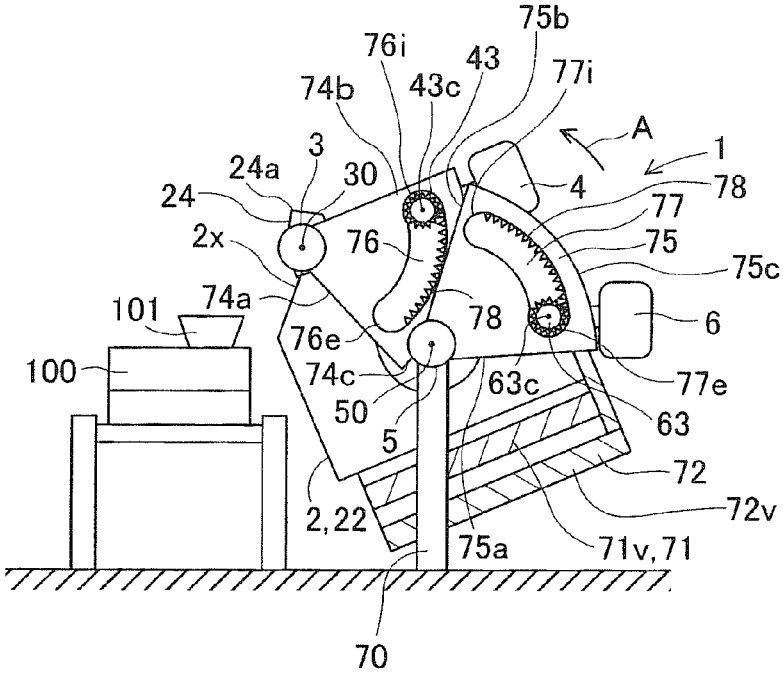
FIG. 6 concerns Embodiment Mode No. 2, and is a conceptual diagram for schematically illustrating a state where the cast-steel pouring apparatus is caused to pivot in a steel-outing direction in a pivotal previous period.

In accordance with the present invention, the cast-steel pouring apparatus 1 comprises a fixation unit 70 being installed onto an installation face, an inner frame 71 retaining the furnace body 2 integrally, an outer frame 72 retaining the inner frame 71 integrally, the first pivot driving source 4, and the second pivot driving source 6, as shown in FIG. 3. The fixation unit 70 is disposed on both sides of the furnace body 2. The outer frame 72 comprises a bottom 72*v*, and is supported pivotably onto the fixation unit 70 by way of the second pivot shaft 5 in the steel-outing direction (i.e., in the arrowheaded direction "A"). When the second pivot driving source 6 is driven rotationally, the outer frame 72 pivots about the second axial line 50 of the second pivot shaft 5, which serves as the pivotal center, in the steel-outing direction (i.e., in the arrowheaded direction "A"), as shown in FIG. 6. The inner frame 71 comprises a bottom 71*v*, and is supported onto the outer frame 72 pivotably about the first axial line 30 of the first pivot shaft 3, which serves as the pivotal center, in the steel-outing direction (i.e., in one of the arrowheaded directions "A"), as retaining the furnace body 2. The first pivot driving source 4 is formed by a motor device, or a motor device with deceleration mechanism, and is fixed onto the outer frame 72, thereby causing a first pinion gear 43 to rotate around a gear center line 43*c* thereof. The second pivot driving source 6 is formed by a motor device, or a motor device with deceleration mechanism, and is fixed onto the fixation unit 70, thereby causing a second pinion gear 63 to rotate around the gear center line 63*c*. Note that, when the first pivot driving source 4 is driven, the first pinion gear 43 rotates about the gear center line 43*c* thereof, which serves as the center, byway of a not-shown transmission mechanism. When the second pivot driving source 6 is driven, the second pinion gear 63 rotates about the gear center line 63*c* thereof, which serves as the center, by way of a not-shown transmission mechanism.

Figure 5:
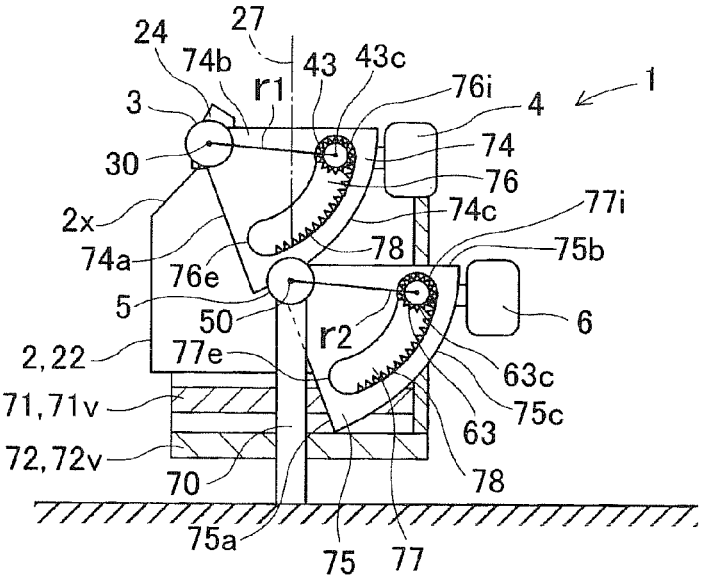
FIG. 5 concerns Embodiment Mode No. 2, and is a diagram for schematically illustrating a cast-steel pouring apparatus that is present at a standby position.

FIG. 5 illustrates a standby state where the furnace body 2 is put in place so as to make the center line 27 of the furnace body 2 orient along the vertical direction. As illustrated in FIG. 5, the second pivot shaft 5 is put in place on a lower side than is the first pivot shaft 3. And, a second pivot body 75 is fixed onto one of the lateral sides of the outer frame 72. The second pivot body 75 has sides (75*a*, 75*b*, 75*c*). The second pivot body 75 further has a second guide groove 77 that is disposed to extend as an arc shape along a pivotal locus in which the second pivot shaft 5 serves as the center. In addition, a first pivot body 74 is fixed onto one of the lateral sides of the inner frame 71, as shown in FIG. 5. The first pivot body 74 is positioned on an upper side to the second pivot body 75, and has sides (74*a*, 74*b*, 74*c*). The first pivot body 74 further has a first guide groove 76 that is disposed to extend as an arc shape along a pivotal locus in which the first pivot shaft 3 serves as the center.

Figure 4:
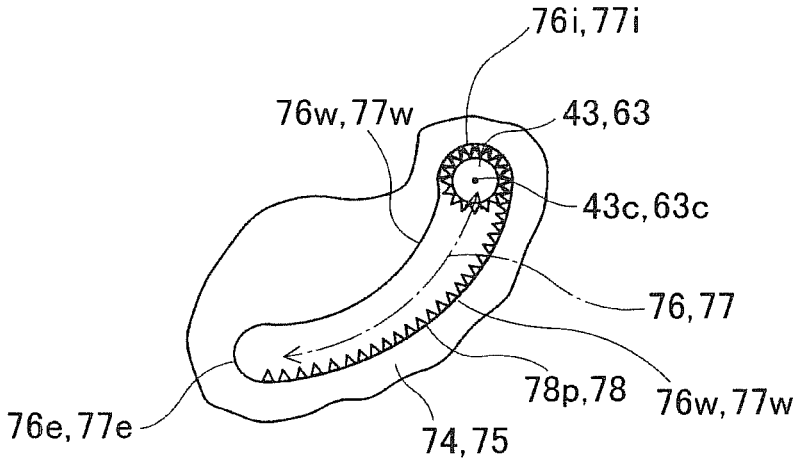
FIG. 4 concerns Embodiment Mode No. 2, and is a conceptual diagram for schematically illustrating meshing between a pinion and racked teeth.

Note that, in accordance with the present embodiment mode, racked teeth 78, with which the first pinion gear 43 meshes as it rotates, are formed on an edge wall 76*w* on an outer-circumference side in the first guide groove 76, as shown in FIG. 4. On an edge wall 77*w* on an outer-circumference side among the second guide groove 77, racked teeth 78, with which the second pinion gear 63 meshes as it rotates, are formed. As can be understood from FIG. 4, when the pinion gears (43, 63) rotate as they mesh with the racked teeth 78, they can move along the guide grooves (76, 88) from the upper-side starting ends (76*i*, 77*i*) of the guide grooves (76, 77) to the lower-side terminal ends (76*e*, 77*e*), respectively. Since the racked teeth 78 are formed on the edge walls (76*w*, 77*w*) on the outer-circumference side among the guide grooves (76, 77), it is possible to enhance the retaining property for the pinion gears (43, 63), so that it is possible to contribute to securing the power-transmitting property.

Next, descriptions will be added on casting molten steel. First of all, in a state where molten steel is retained inside the retainer chamber 20 in the furnace body 2, the furnace body 2 is on standby so that the center line 27 of the furnace body 2 orients along the vertical direction, as shown in FIG. 5. It is also allowable that the induction heating coil 220 can be subjected to power feeding so that the molten steel in the retainer chamber 20 is heated, or it is even permissible that the molten steel cannot be heated. In this case, the second pinion gear 63 is positioned at the upper-side starting end 77*i* in the second guide groove 77, as shown in FIG. 5, as meshing with the racked teeth 78 of the second guide groove 77. Similarly, the first pinion gear 43 is positioned at the upper-side starting end 76*i* in the first guide groove 76, as meshing with the racked teeth 78 of the first guide groove 76.

The cast-steel pouring apparatus 1 shifts from this standby state to a pivotal previous period. In this case, the lower-side second pivot driving source 6 is first of all driven rotationally in order to cause the second pinion gear 63 to rotate around the gear center line 63*c* thereof, in a state where driving the upper-side first pivot driving source 4 is caused to stop. In this case, the second pinion gear 63 rotates about the gear center line 63*c*, as meshing with the second racked teeth 78 of the second guide groove 77, in a state where the second pinion gear 63 is retained at its height position. Consequently, the lower-side second pivot body 75 pivots to the upper side about the second axial line 50 of the lower-side second pivot shaft 5, which serves as the pivotal center, toward the steel-outing direction (i.e., in the arrowheaded direction "A") (see FIG. 6). In this case, since the second pinion gear 63 rotates around the gear center line 63*c*, as it meshes with the racked teeth 78, in a state where it is maintained at a predetermined position, the second guide groove 77 and second pivot body 75 rotates integrally to the upper side toward the steel-outing direction (i.e., in the arrowheaded direction "A") (see FIG. 6). Since the second pivot body 75 is thus pushed up, the terminal end 77*e* in the guide groove 77 of the second pivot body 75 reaches the second pinion gear 63 (see FIG. 6).

Thus, in the pivotal previous period, the second pivot body 75 pivots about the second axial line 50 of the second pivot shaft 5, which serves as the pivotal center, in the steel-outing direction (i.e., in the arrowheaded direction "A"), as being shown in FIG. 6. In this case, the outer frame 72, which retains the second pivot body 75 integrally, pivots in the same direction, too. Similarly, as can be understood from FIG. 6, not only the inner frame 71 that is retained in the outer frame 72, but also the furnace body 2 that is retained in the inner frame 71 pivot in the same direction by the same pivotal angle. Thus, at the stage of the pivotal previous period, the first pinion gear 43 is put in a state where it is kept being positioned at the starting end 77*i* in the first guide groove 76, as shown in FIG. 6, because the first pivot driving source 4 is not driven rotationally, although the second pivot driving source 6 is driven rotationally.

Figure 7:
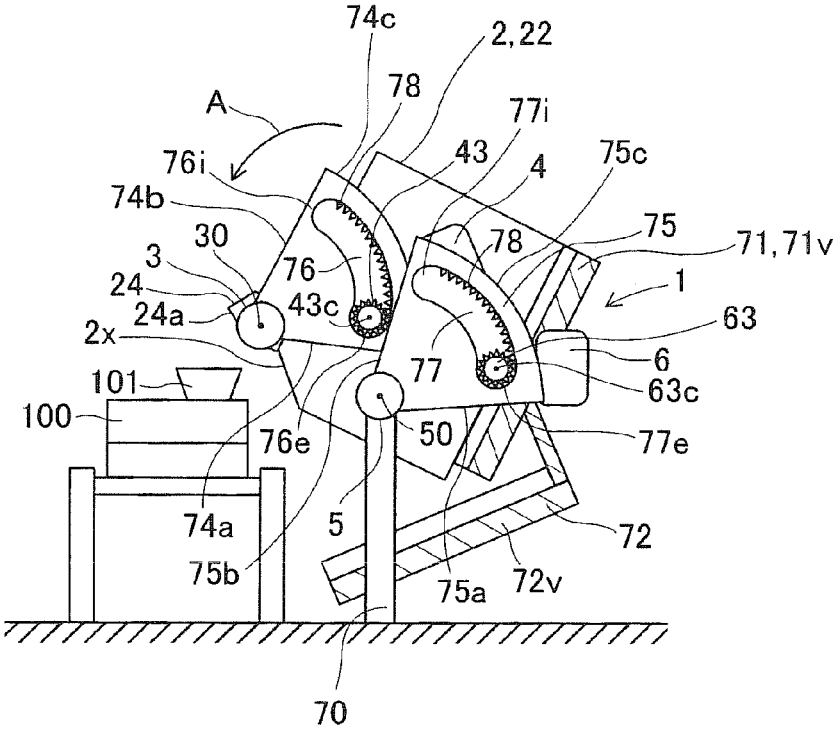
FIG. 7 concerns Embodiment Mode No. 2, and is a conceptual diagram for schematically illustrating a state where steel outing is done from a furnace body of the cast-steel pouring apparatus to a sprue of casting mold in a pivotal later period.

Next, the cast-steel pouring apparatus 1 shifts from the pivotal previous period to the pivotal later period. That is, in a state where driving the second pivot driving source 6 is caused to stop, the first pivot driving source 4 is caused to be driven rotationally. As a result, the first pinion gear 43 rotates about the gear center 43*c* thereof, as meshing with the racked teeth 78 of the first guide groove 76. In this case, the first pivot body 74 having the first guide groove 76 pivots furthermore toward the upper side about the first axial line 30 of the first pivot shaft 3, which serves as the pivotal center, in the steel-outing direction (i.e., in the arrowheaded direction "A"), as shown in FIG. 7. Consequently, the terminal end 76*e* in the first guide groove 76 reaches the first pinion gear 43 (see FIG. 7).

As a result, the inner frame 71 having the first pivot body 74, along with the furnace body 2 being retained in the inner frame 71, pivots about the first axial line 30 of the first pivot shaft 3, which serves as the pivotal center, in the steel-outing direction (i.e., in the arrowheaded direction "A"), as shown in FIG. 7. In this case, the outer frame 72 retaining the second pivot body 75 therein is kept being stopped at the pivotal position at the terminal time point in the pivotal previous period (see FIG. 7), because rotationally driving the second pivot driving source 6 is caused to stop. In the pivotal later period like this, the first pivot body 74 of the inner frame 71, and eventually the furnace body 2 being retained in the inner frame 71 pivot furthermore in the steel-outing direction (i.e., the arrowheaded direction "A"), while causing the outer frame 72 to reside at the terminal position in the pivotal previous period. As a result, molten steel, which is retained in the retainer chamber 2 of the furnace body 2, is poured toward the sprue 101 of the casting mold 100, and is then cast thereinto (see FIG. 7).

In the embodiment mode like this, the driving forces of the pivot driving sources (4, 6) are input into the pinion gears (43, 63), respectively. Here, as can be understood from FIG. 5, a distance "r1" between the gear center line 43*c* of the pinion gear 43 and the first axial line 30 of the first pivot shaft 3 is secured. Similarly, another distance "r2" between the gear center line 63*c* of the pinion gear 63 and the second axial line 50 of the second pivot shaft 5 is secured. Since the distances (r1, r2) are thus secured, it is possible to increase pivotal moments. Hence, even when a weight of the molten steel in the retainer chamber 20 is heavy, such an advantage is available that it is unnecessary to cause the driving forces of the pivot driving sources (4, 6) to increase excessively, and thereby it is possible to contribute to downsizing the pivot driving sources (4, 6).

As illustrated in FIG. 5 through FIG. 7, a dented retraction portion 2*x* is formed in a region among the furnace body 2 that faces to the casting mold 100. The retraction portion 2*x* inclines with respect to the center line 27 of the furnace body 2. In accordance with the present embodiment mode like this, the furnace body 2 (i.e., the retraction portion 2*x*) is suppressed from interfering with the casting mold 100 even when subjecting the furnace body 2 to steel outing by causing it to pivot as letting it approach the casting mold 100. Therefore, it is advantageous for doing steel outing as causing the furnace body 2 to approach the casting mold 100.

Figure 8:
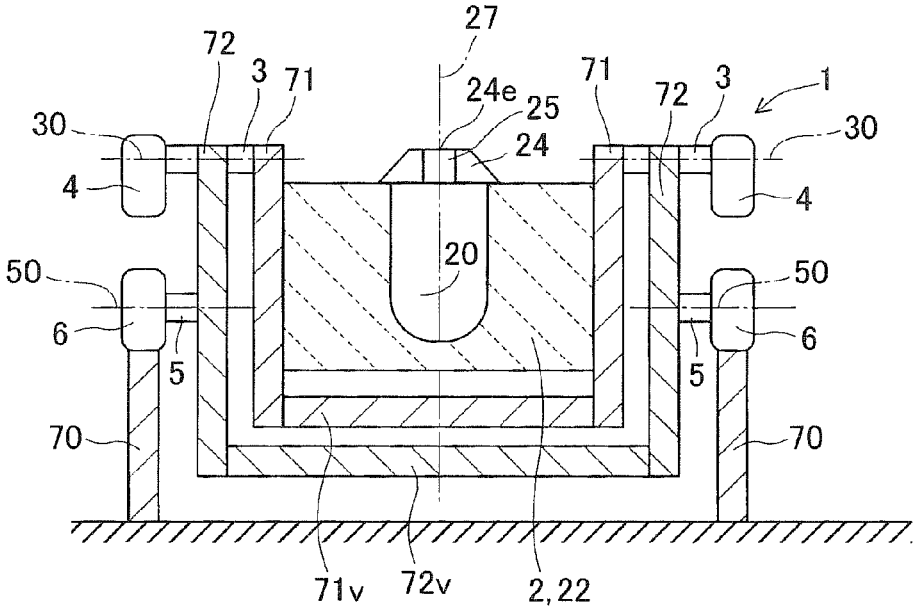
FIG. 8 concerns Embodiment Mode No. 3, and is a conceptual diagram for schematically illustrating a furnace body, which is present at a standby position, from a different direction.
Figure 9:
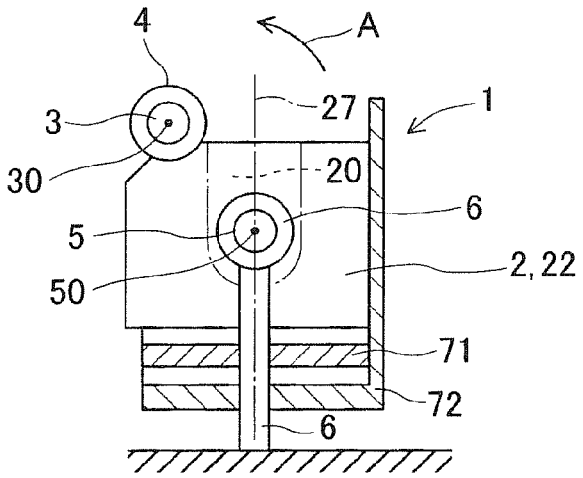
FIG. 9 concerns Embodiment Mode No. 3, and is a conceptual diagram for schematically illustrating the furnace body that is present at the standby position.

FIG. 8 and FIG. 9 illustrate concepts of Embodiment Mode No. 3 schematically. Since the present embodiment mode comprises the same constructions, as well as the same operations and advantageous effects, as those of Embodiment Mode Nos. 1 and 2 fundamentally, FIG. 1 and FIG. 2 are used compliantly. As can be understood from FIG. 1 and FIG. 2 (i.e., a cross-sectional diagram along the center line 27 of the furnace body 2 and along the vertical line) that are used herein compliantly, the first axial line 30 of the first pivot shaft 3 is positioned on a more diametrically inner side than is the first imaginary extension line "P1" of the outer-circumference wall face 28 in the furnace-body main body 22 in the diametric direction of the furnace-body main body 22 (i.e., in the arrowheaded directions "D"), and is positioned on a more diametrically outer side than is the second imaginary extension line "P2" of the inner-circumference wall face 29 of the fire-retardant lining material 21 in the furnace-body main body 22. In the same manner as Embodiment Mode No. 1, as the steel-outing trough unit 24 protrudes from the furnace body 2 to the upside and outside obliquely, the steel-outing leading end 24*e* of the steel-outing trough unit 24 is positioned on a diametrically inner side than is the first imaginary extension line "P1" of the outer-circumference wall face 28 in the furnace-body main body 22, and is positioned on a diametrically outer side than is the second imaginary extension line "P2" of the inner-circumference wall face 29 of the fire-retardant lining material 21 in the furnace-body main body 22.

In accordance with the present embodiment mode, on an extension line of the first axial line 30 of the first pivot shaft 3, the first pivot driving source 4 is disposed so as to be positioned on an outer side of the furnace body 2 and outer frame 72, as can be understood from FIG. 8 and FIG. 9. On an extension line of the second axial line 50 of the second pivot shaft 5, the second pivot driving source 6 is disposed so as to be positioned on an outer side of the furnace body 2 and outer frame 72. The first pivot driving source 4 and second pivot driving source 6 are formed by a motor device with deceleration mechanism, respectively. As being aforementioned, on the extension line of the first axial line 30 of the first pivotal shaft 3, the first pivot driving source 4 is disposed coaxially therewith. On the extension line of the second axial line 50 of the second pivotal shaft 5, the second pivot driving source 6 is disposed coaxially therewith. Consequently, structures for transmitting the driving forces are simplified.

FIG. 9 illustrates a state where the furnace body 2 is on standby so that the center line 27 of the furnace body 2 orients along the vertical direction. In this case, the cast-steel pouring apparatus 1 pivots from this standby state. In this case, in a pivotal previous period, the second pivot driving source 6 is first of all driven rotationally in order to put the cast-steel pouring apparatus 1 in the pivotal previous period, in a state where driving the first pivot driving source 4 is caused to stop. Next, the cast-steel pouring apparatus 1 shifts from the pivotal previous period to a pivotal later period. That is, in a state where rotationally driving the second pivot driving source 6 is caused to stop, the first pivot driving source 4 is driven rotationally. When the first pivot driving source 4 is thus driven rotationally, pivoting occurs about the first axial line 30 of the first pivotal shaft 3, which serves as the pivotal center, in the steel-outing direction (i.e., in the arrowheaded direction "A"). In this case, driving the second pivot driving source 6 rotationally is caused to stop.

Figure 10:
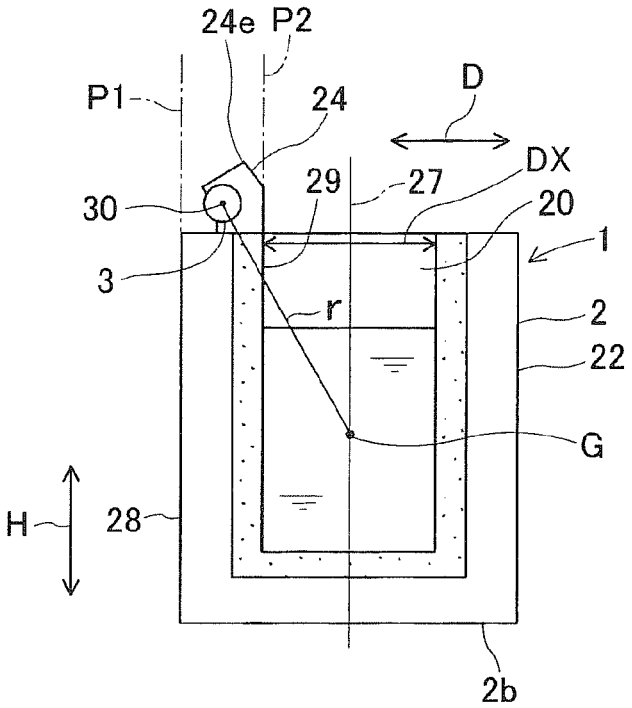
FIG. 10 concerns Embodiment Mode No. 4, and is a conceptual diagram for schematically illustrating a furnace body that is present at a standby position.
Figure 11:
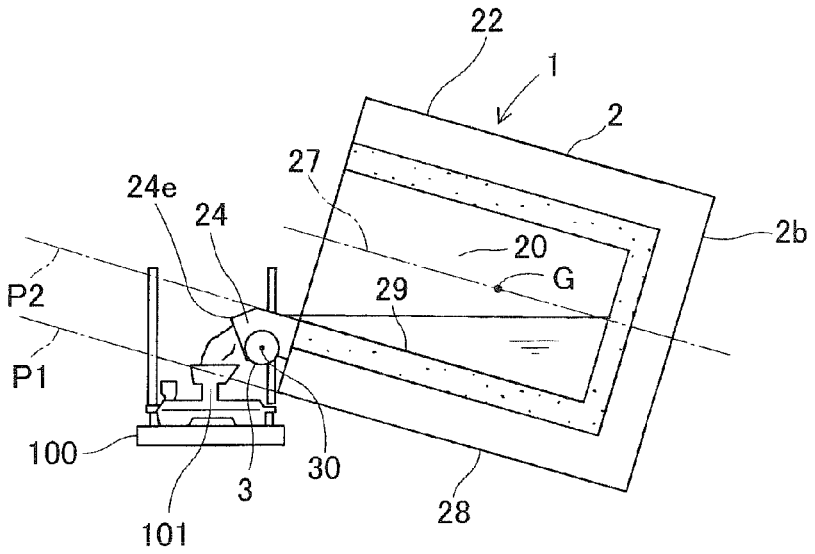
FIG. 11 concerns Embodiment Mode No. 4, and is a diagram for schematically illustrating a state where pouring is done from the furnace body, which is present at a casting position, to a sprue of casting mold.

FIG. 10 and FIG. 11 illustrate Embodiment Mode No. 4. The present embodiment mode comprises the same constructions, as well as the same operations and advantageous effects, as those of Embodiment Mode Nos. 1 and 2 fundamentally. The present embodiment mode is suitable for a case where the volume of the retainer chamber 20 is small. In the same manner as Embodiment Mode No. 1, the steel-outing trough unit 24 protrudes from the top portion of the furnace body 2 to the upside and outside obliquely, in FIG. 10 that illustrates the standby position. And, in the diametric direction (i.e., in the arrowheaded directions "D"), the first axial line 30 of the first pivot shaft 3 is positioned on a more diametrically inner side than is the first imaginary extension line "P1" of the outer-circumference wall face 28 in the furnace-body main body 22, and is positioned on a more diametrically outer side than is the second imaginary extension line "P2" of the inner-circumference wall face 29 of the fire-retardant lining material 21 in the furnace-body main body 22. In addition, in the same manner as Embodiment Mode No. 1, the steel-outing leading end 24*e* of the steel-outing trough unit 24 is positioned on a diametrically inner side than is the first imaginary extension line "P1" of the outer-circumference wall face 28 in the furnace-body main body 22, and is positioned on a diametrically outer side than is the second imaginary extension line "P2" of the inner-circumference wall face 29 of the fire-retardant lining material 21 in the furnace-body main body 22, in the diametric direction, according to FIG. 10 that illustrates the standby position. However, the second pivotal shaft 5 and second pivot driving source 6 are not loaded thereonto at all. Therefore, the execution is done from the standby position to the casting position by means of rotationally driving the first pivot driving. Note that the furnace body 2 is a ladle having the retainer chamber 20 that retains molten steel therein. However, the furnace body 2 does not comprise any function of actively heating the molten steel in the retainer chamber 20, because it does not comprise any induction heating coil.

The present invention is not one which is limited to the embodiment modes alone that are mentioned above and are illustrated in the drawings, but can be executed by properly making alterations thereto within a scope that does not deviates from the gist. It is also allowable that the fixation unit 70 can be fixed onto the installation face, or it is even allowable that the fixation unit 70 can be a movable-type fixation unit being conveyed along the installation face.

The invention claimed is:

1. A cast-steel pouring apparatus comprising:

a furnace body having a furnace-main-body that includes a fire-retardant lining material demarcating a retainer chamber for retaining molten steel therein, and a steel-outing trough that protrudes from the furnace-main-body towards an outside and having a trough length equal to ⅔ or less of an inside diameter of a top-face opening in the retainer chamber;

a first pivot shaft connected to an underside of the steel-outing trough and having a first axial line oriented along a lateral direction such that the furnace body can pivot on the first pivot shaft in a longitudinal direction, which serves as the pivotal center;

a first pivot driving source for pivoting the furnace body about the first axial line of the first pivot shaft in the longitudinal direction;

a second pivot shaft disposed in the furnace main-body and having a second axial line that orients in the lateral direction which allows the furnace body to pivot on the second pivot shaft in a longitudinal direction; and a second pivot driving source for pivoting the furnace body shaft in the longitudinal direction towards the steel-outing trough about the second axial line of the second pivot shaft which serves as the pivotal center, such that the second pivot driving source pivots the furnace body in the longitudinal direction towards the steel-outing trough without causing the molten steel in the retainer chamber to be discharged from the steel-outing trough then the first pivot driving source further pivots the furnace body about the first pivot shaft in the longitudinal direction thereby positioning the steel-outing trough in proximity to a sprue of a casting mold thereby causing the molten steel in the retainer chamber to be discharged from the steel-outing trough into the sprue of the casting mold.

2. The cast-steel pouring apparatus of claim 1, further comprising:

a fixation unit;

an outer frame being supported onto the fixation unit and can pivot about the second pivot shaft which serves as the pivotal center, in the longitudinal direction towards the steel-outing trough; and an inner frame retaining the furnace body therein, the inner frame being supported onto the outer frame and can pivot about the first pivot shaft which serves as the pivotal center, in the longitudinal direction towards the steel-outing trough.

3. The cast-steel pouring apparatus of claim 1, wherein the first driving source is a motor and the second driving source is one or more of a motor, a crane sling and a fluidic-pressure cylinder device.

4. The cast-steel pouring apparatus of claim 1, wherein the furnace-main-body further includes an induction heating coil.

5. The cast-steel pouring apparatus of claim 1, wherein the steel-outing trough includes a concave shaped portion that is disposed in a bottom wall of a steel-outing trough passage such that the concave shaped portion is deeper than the bottom wall of the steel-outing trough passage.

6. The cast-steel pouring apparatus of claim 2, further comprising:

a first pivot body having a first arc-shaped guide groove positioned along a pivotal locus in which the first pivot shaft serves as a center; and a second pivot body having a second arc-shaped guide groove positioned along a pivotal locus in which the second pivot shaft serves as the center.

7. The cast-steel pouring apparatus of claim 6, wherein the first arc-shaped guide groove includes racked teeth for meshing with a first pinion gear, and the second arc-shaped guide groove includes racked teeth for meshing with a second pinion gear.

8. The cast-steel pouring apparatus of claim 1, further comprising:

a dented retraction portion formed in a region of the furnace body facing the casting mold, the dented retraction portion being beneath the first pivot shaft and the underside of the steel-outing trough.

* * * * *